United States Patent [19]

Caldarelli

[11] 4,040,772

[45] Aug. 9, 1977

[54] FLUID ENERGY SYSTEM

[76] Inventor: Antonio Caldarelli, Apt. 29, Clinton Manor, 281 W. Clinton St., Dover, N.J. 07801

[21] Appl. No.: 503,255

[22] Filed: Sept. 5, 1974

[51] Int. Cl.[2] ..... F04B 17/00

[52] U.S. Cl. ..... 417/364; 417/393; 92/160

[58] Field of Search ..... 417/364, 393, 396, 394, 417/395; 92/160, 158

[56] References Cited

U.S. PATENT DOCUMENTS

| | | | |
|---|---|---|---|
| 533,449 | 2/1895 | Erwin | 417/396 X |
| 872,603 | 12/1907 | Alken | 417/364 |
| 1,608,947 | 11/1926 | Maegly | 92/160 X |
| 2,949,858 | 8/1960 | Costley | 417/364 X |
| 3,172,596 | 3/1965 | King | 92/160 X |
| 3,207,080 | 9/1965 | Schlosser | 417/393 X |
| 3,266,435 | 8/1966 | Smith | 92/160 X |
| 3,400,533 | 9/1968 | Wenzel | 417/364 X |
| 3,494,262 | 2/1970 | Holcombe | 92/160 X |

FOREIGN PATENT DOCUMENTS

| | | | |
|---|---|---|---|
| 2,863 of | 1868 | United Kingdom | 417/393 |

*Primary Examiner*—Carlton R. Croyle
*Assistant Examiner*—Leonard Smith
*Attorney, Agent, or Firm*—Thomas N. Neiman

[57] ABSTRACT

The system comprises a plurality of engine subassemblies having double-acting pistons, for generating power and pressuring fluid for work. Each piston undergoes a power stroke, under the influence of energized fluid addressed thereto and, during the power stroke, the piston(s) pressurizes fluid for powering ancillary fluid-powered machines. The latter fluid is admitted through channels formed in the pistons to lubricate the pistons in their reciprocation in cylinders. Each of the cylinders is enclosed in a surrounding coolant chamber. A carrier element is employed for effecting a common translation of all pistons, and the carrier element supports extending actuators which, through a "lost motion" arrangement, actuate a valve-operating system coupled to the heads of the cylinders. Limit-stop springs, interposed between the carrier element and housings (which confine the cylinders) delimit the travel of the pistons. Also, the carrier element has a ferrous-metal rod projecting therefrom for close-coupled engagement with an electro-magnetic coil for, at least, effecting a start-up of the system.

4 Claims, 14 Drawing Figures

FIG. 2
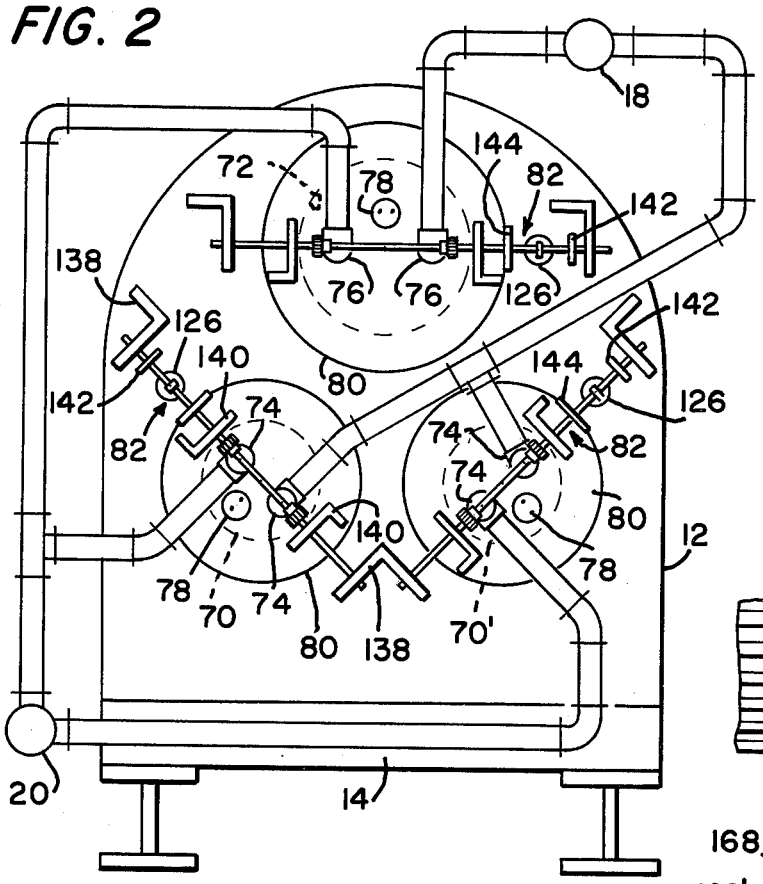
FIG. 10
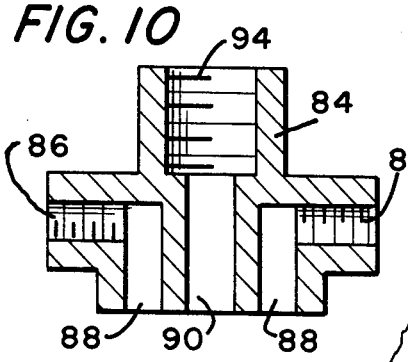
FIG. 11
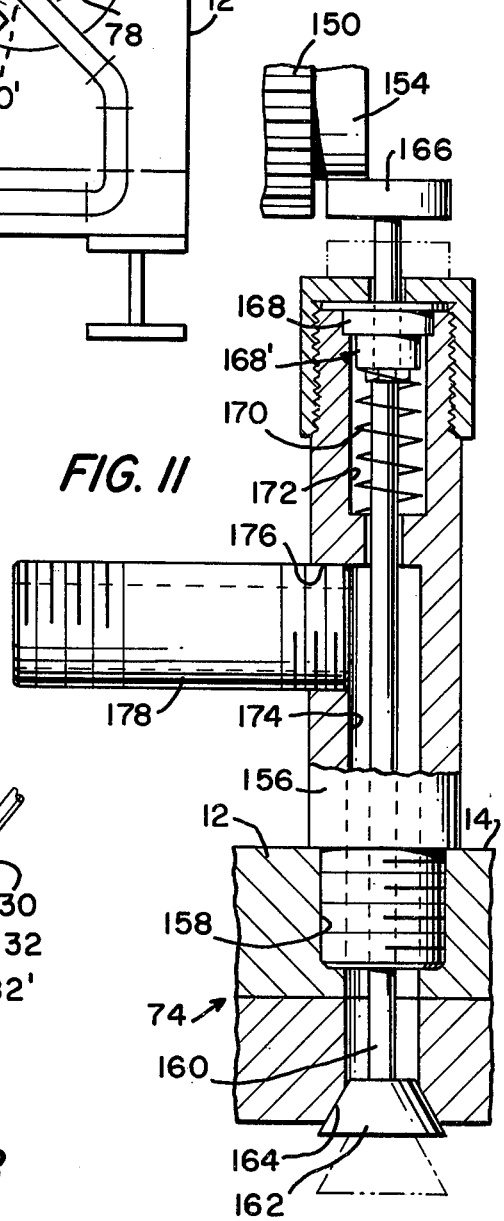
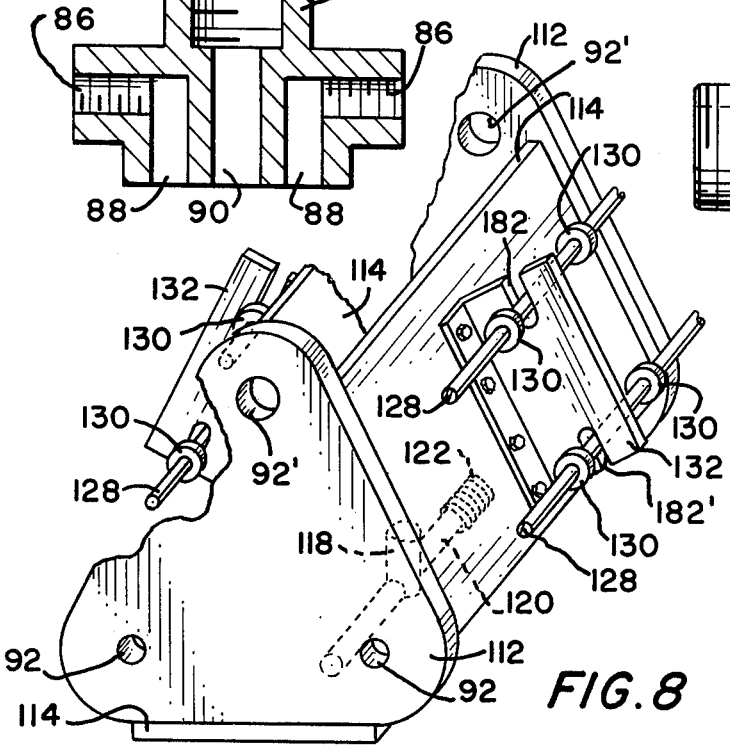
FIG. 8

FLUID ENERGY SYSTEM

This invention pertains to fluid energy systems, and in particular to such systems which generate power from an energized fluid, in an engine, and use the engine-developed power to operate ancillary machines.

Systems of this type, known in the prior art, communicate engine-developed power through power take-off shafts, and the like, enable compressors or pumps, and similar machines from shaft torque, in that the compressors or pumps might pressure fluid for useful work. Thus, what is involved in such known systems is a sub-system of coupling and translation, between the engine and the fluid-pressuring machine(s), which not uncommonly is rather complex and, accordingly, suffers a loss of power.

A more efficient fluid energy system would be one in which an engine developing power strokes would, coincidentally, pressure working fluid. Such an efficient system would dispense with the distance, coupling, and torque transmission and translation practiced in prior art systems, and marry the pressured-fluid system to the engine pistons in common housings or cylinders.

It is an object of this invention, then, to disclose such an improved and efficient fluid energy system.

Particularly, it is an object of this invention to set forth a fluid-energy system comprising means defining a fluid-powered engine; said engine-defining means comprising means for generation pressured fluid; means for storing pressured fluid; means for conducting pressured fluid from said engine-defining means to said storing means for storage; and means for discharging stored, pressured fluid from said storing means for use in powering ancillary fluid-powered machines; wherein said engine-defining means define at least one reciprocating, fluid-powered engine; said at least one engine having at least one cylinder and a piston reciprocatable within said cylinder; said piston being double-acting; said system further including means for addressing energized fluid to one end of said piston, to cause said piston to be driven in a power stroke; and means for addressing fluid to an end of said piston opposite said one end, to cause said latter fluid to be pressured by said piston during power strokes of said piston; and wherein said piston has means for communicating fluid addressed to an end thereof with slidably interfacing walls of said piston and said cylinder for lubricating said walls.

A feature of this invention comprises a plurality of engine subassemblies having double-acting pistons, for generating power and for pressuring fluid for work. As each piston undergoes a power stroke it simultaneously pressurizes fluid — for powering ancillary machines. The machines-powering fluid is admitted through channels formed in the pistons to lubricate the piston and cylinder walls, and each of the cylinders is enclosed in a surrounding coolant chamber. A carrier element is employed to cause a common translation of all pistons, the element also supporting extending actuators which, through a lost motion arrangement, actuate a valve-operating system. The latter is fixed to the heads of the cylinders.

Further objects and features of this invention will become more apparent by reference to the following description, taken in conjunction with the accompanying figures, in which:

FIG. 2 is an elevational view of the engine power side of one of the engines;

FIG. 8 is a fragmentary, isometric view of the carrier element and the FIG. 6 sub-system;

Figure 12:
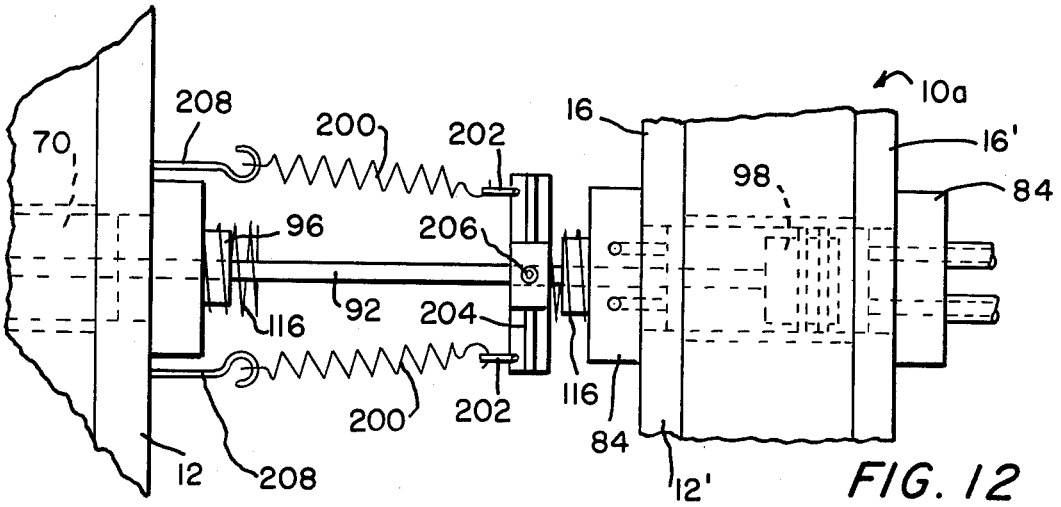
Figure 13:
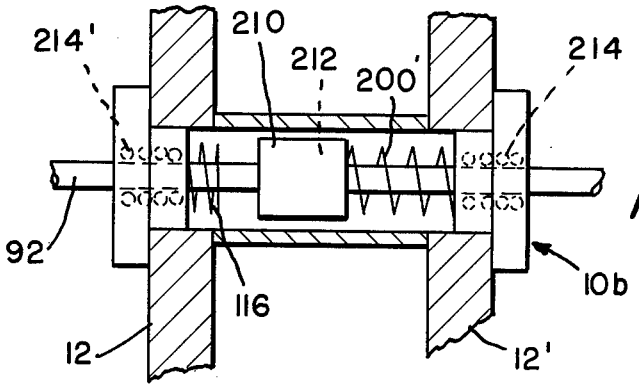
Figure 14:
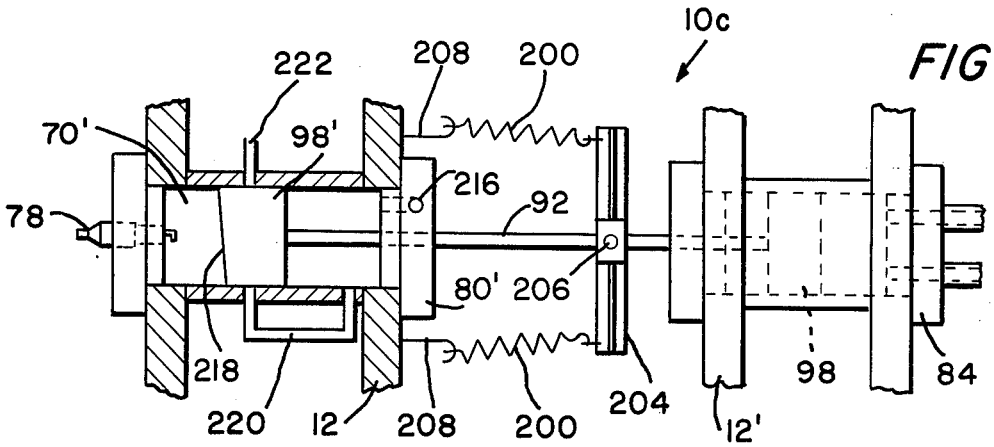

FIGS. 10 and 11, respectively, are cross-sectional views of the closing head of the pressured-fluid side of the engine, and the valving structure of the power side of the engine; and FIGS. 12–14 are fragmentary, plan views of alternate embodiments of the invention depicting alternative piston/shaft return arrangements, and the employment of the novel concept in a two-stroke-cycle engine.

Figure 1:
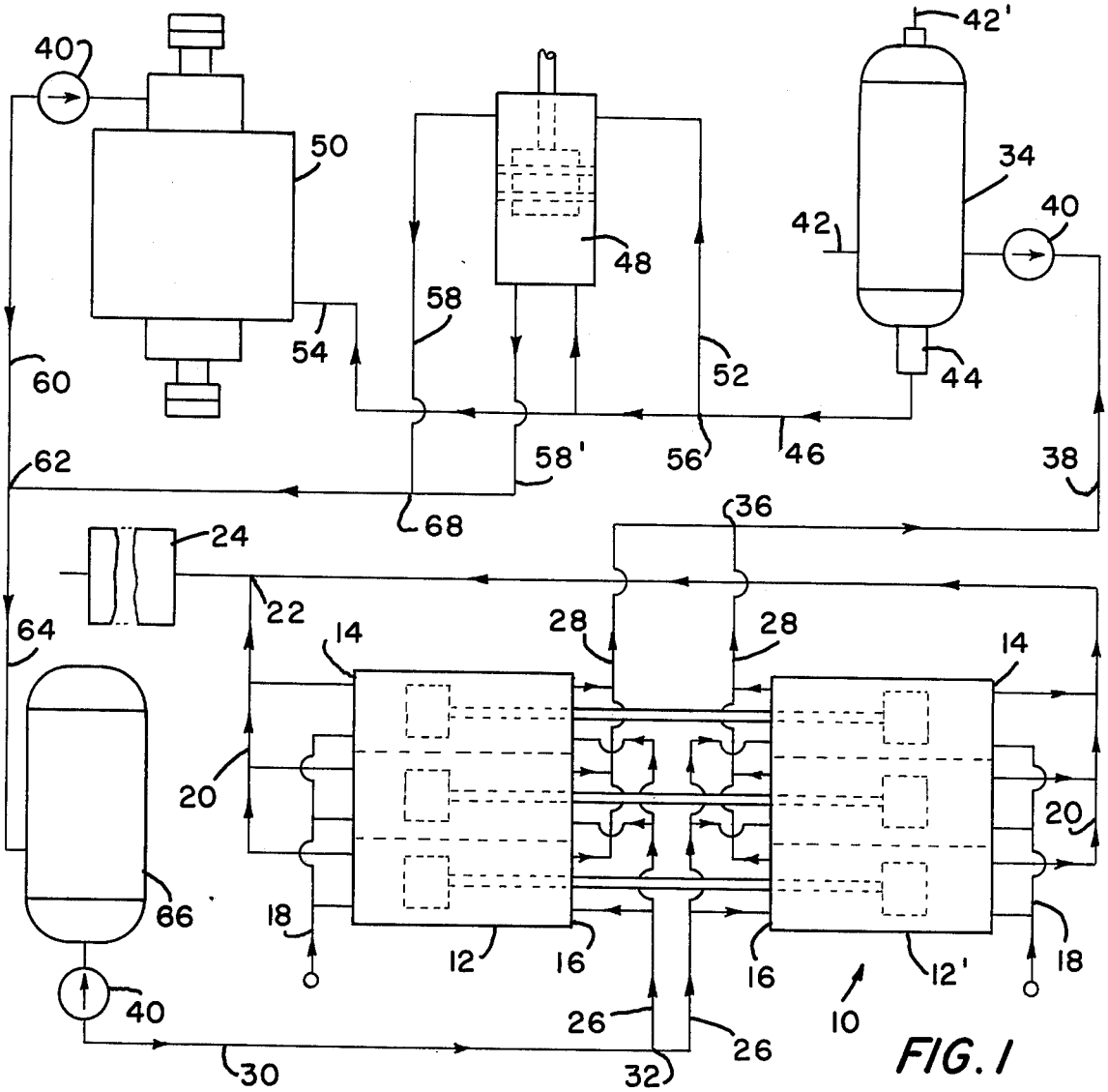
FIG. 1 is an over-all schematic diagram of a fluid energy system incorporating the novel invention.

As shown in FIG. 1, the novel system 10, according to an embodiment thereof, comprises a plurality of engine subassemblies operative in opposed housings 12 and 12′. Each engine subassembly, and thus each housing, has an engine power side 14 and a pressured-fluid side 16. Fuel inlet manifolds 18, via branch lines, supply fuel to the engines, and exhaust manifolds 20, too via branch lines, vent exhausted fuel from the engines. Manifolds 20 are joined at 22 for communication with a muffler 24.

Fluid to be pressured for work is admitted to the engines via manifold lines 26 at the pressured-fluid side. Pressured-fluid outlets 28 from the sides 16 of the housings comprise manifolds with similar branch lines. The to-be-pressured fluid is supplied to manifold lines 26 from a supply line 30 through a common junction 32.

The pressured fluid, of course, may be put to any useful work. However by way of example FIG. 1 depicts the conduct of the fluid to ancillary fluid-operative or -responsive machines, via a storage chamber 34. Chamber 34 is coupled to outlets or manifolds 28 through a common juncture 36 and an output line 38. A check valve 40, interposed in line 38, prevents evacuation of the chamber — permitting flow in only one direction through line 38. Chamber 34 pressure- and temperature-sensing taps 42 and 42′.

Chamber 34 has a pressured-fluid outlet 44 which feeds to a line 46 for supplying pressured fluid to an ancillary reciprocating engine 48 (or linear actuator) and an ancillary fluid-responsive rotary machine 50. The engine (or actuator) 48 and machine 50 are supplied motive fluid via lines 52 and 54, respectively, the latter having a common juncture 56 with line 46. The ancillary devices 48 and 50 vent the used fluid via lines 58 and 60, respectively, to a common juncture 62. Juncture 62 is also joined to a line 64 which supplies the spent fluid to a reservoir 66. Line 30, which has a check valve 40 interposed therein, receives the spent fluid from the reservoir 66 for re-pressuring in system 10. Line 60 also has a check valve 40 interposed therein, and a secondary discharge line 58′ joins line 58 at a juncture 68. Other check valves (not shown) are used in the system to insure unidirectional flow.

The engine power side 14 of one of the engines, shown in FIG. 2, illustrates the coupling of the manifolds 18 and 20 to the housing 12 for communication with the engine cylinders 70, 70' and 72 and the valves 74, 74' and 76. Ignition devices 78 are fixed in the heads 80 of the cylinders. A valve-operating sub-assembly 82, described in further detail in the ensuing text, is shown in operative association with each of the valves.

Figure 3:
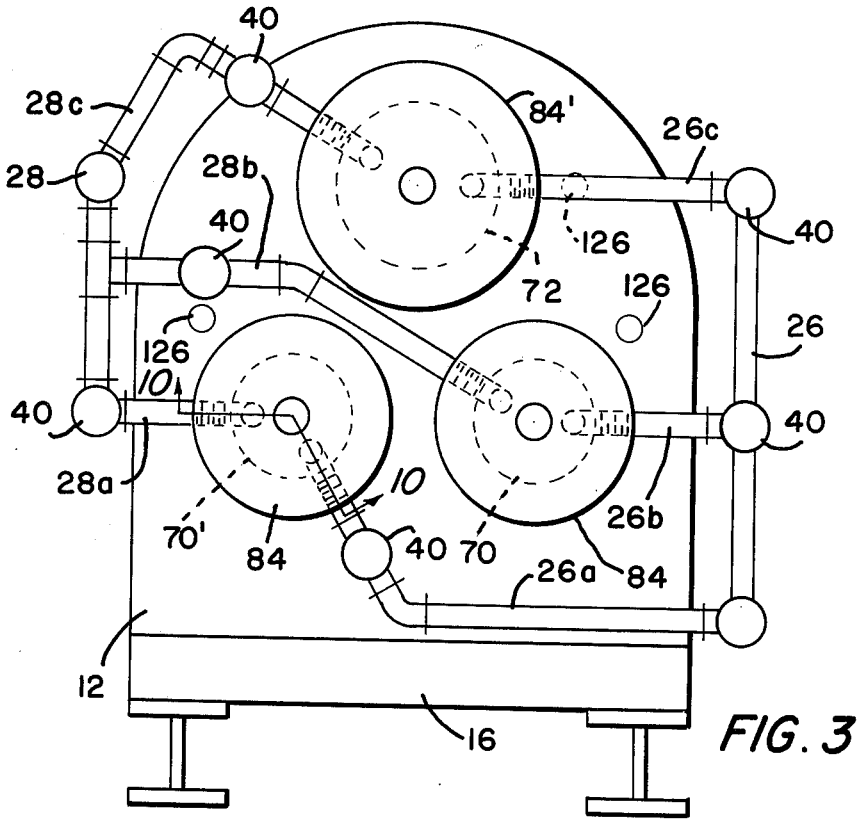
FIG. 3 is an elevational view of the pressured-fluid side of one of the engines.
Figure 5:
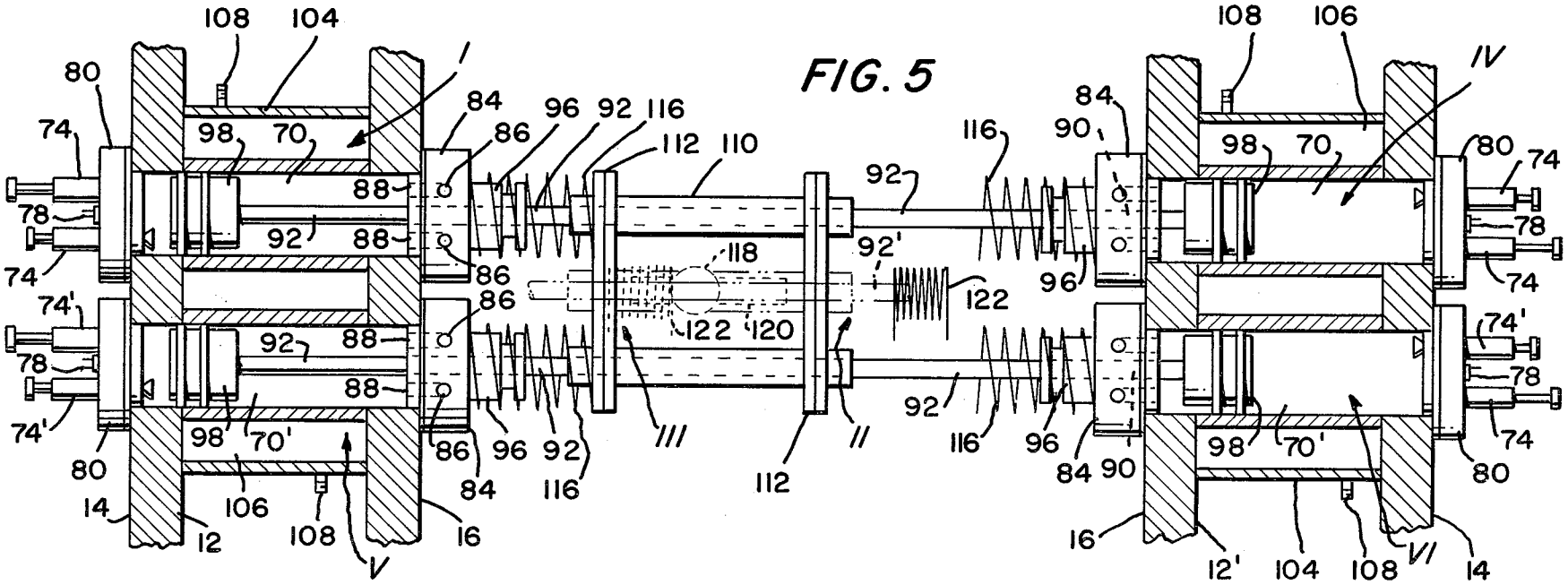
FIG. 5 is a longitudinal view taken, partly in cross-section, through the axial-translation plane of the system's two, lowermost engine subassemblies.

The pressured-fluid side 16 of one of the engines, shown in FIG. 3, illustrates the coupling of the manifolds 26 and 28 to the housing 12, also for communication with the engine cylinders 70, 70' and 72. Branch lines 26*a,* and 26*c* and 28*a,* 28*b,* and 28*c* each have check valves 40 interposed therein to insure a proper unidirectional flow of the fluid. Each of the cylinders has a closure head 84 (or 84') which FIGS. 5 and 10 show in greater detail. Closure heads 84 (and 84') are laterally and axially ported, at 86 and 88, in order that the former might communicate with branches 26*a – c,* and 28*a – c,* and for the latter to open onto the cylinders 70, 70' and 72. Each head is also centrally bored at 90 for slidably receiving a piston rod 92, or 92'. The outermost end of bore 90 is enlarged and threaded at 94 to receive a rod packing gland 96.

Figure 9:
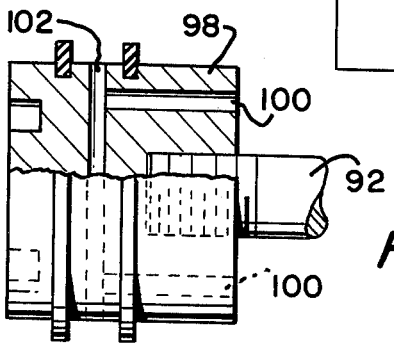
FIG. 9 is a side, elevational view of one of the pistons, the same being half cross-sectioned.

FIG. 9 depicts the structural detail of the pistons 98, and it can be seen that the same have first axial bores 100 which communicate with a transverse bore 102. In addition to pressuring the fluid supplied to cylinders 70, 70' and 72, the pistons 98 communicate fluid through bores 100 and 102 to lubricate the interfacing walls of the cylinders and pistons. Each housing 12, 12' has an enveloping shell 104 which defines a coolant chamber 106 surrounding the cylinders 70, 70' and 72. By means of coolant inlet and outlet fittings 108, coolant is conducted into and out of chamber 106 to carry off heat.

Figure 4:
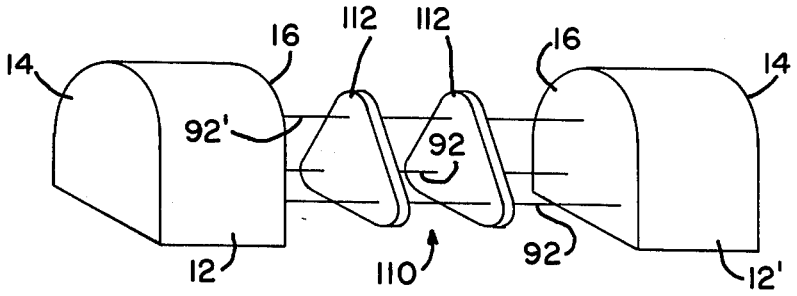
FIG. 4 is a simplified outline diagram, in perspective, of the pair of opposed engine housings and the pistons-coupling carrier element.

The piston rods 92 (and 92') are co-axially joined, for common reciprocation, by means of a carrier element 110. Carrier element 110 comprises a pair of generally triangular-shaped plates 112 (FIGS. 4, 5, 8) which are fixed together by bolted plates or weldments 114 (bracing and other supports therefor not being shown). Limit-stop springs 116 are disposed about the rods 92 (and 92') for interpositioning between the carrier element 110 and the closure heads 84 (and 84') for resiliently delimiting axial travel of the rods, pistons and element 110. Additionally, element 110 carries an underslung stub 118 to which is fixed a ferrous metal rod 120. Rod 120 is disposed in parallel with the axial travel of the rods 92 (and 92') and makes a close-coupled engagement or insertion thereof with electro-magnetic coils 122. Coils 122 are mechanically supported, and electrically energized by means not shown (the same being within the ken of those skilled in this art), for selectively and alternatively attracting and repelling axially-extending ends of rod 120 — at least for initiating system operation.

Figure 6:
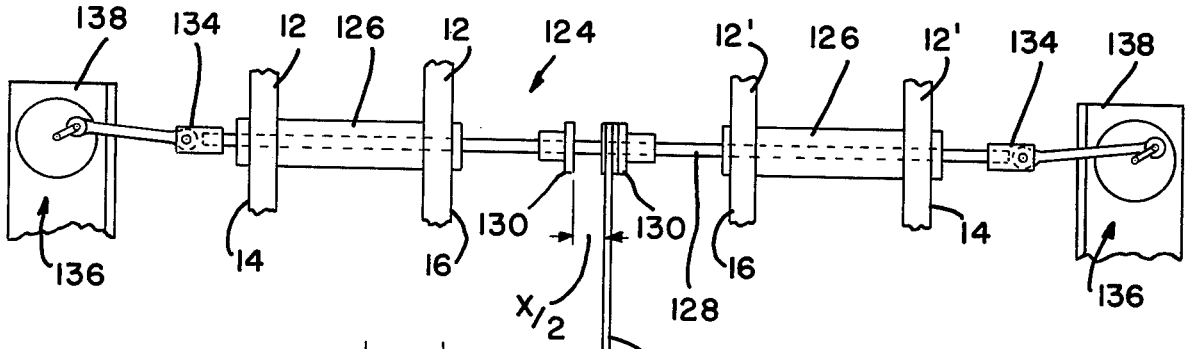
FIGS. 6 and 7 are side, elevational views of the valve-actuating or operating sub-systems.

A valve operating sub-assembly 124, shown in FIG. 6, is used for cooperation with sub-assembly 82 to operate the valves 74, 74' and 76. Hollow members 126 are fixed through the housings 12 and 12' for slidably receiving a translating rod 128. Slide bearings (not shown) are arranged at the housing ends to support the translating rod. Intermediate the axial length thereof, rod 128 carries spaced-apart flanged sleeves 130. Pistons 98 exhibit a travel distance X and sleeves 130 are set apart half that distance: X/2 whereby, by means discussed in the following text, the rod 128 travels half the distance of the pistons and, for each translation of the pistons, manifest a lost motion delay in response to piston travel. It is to be understood that other types of valving and valve controls can be used in the practice of the invention.

Figure 7:
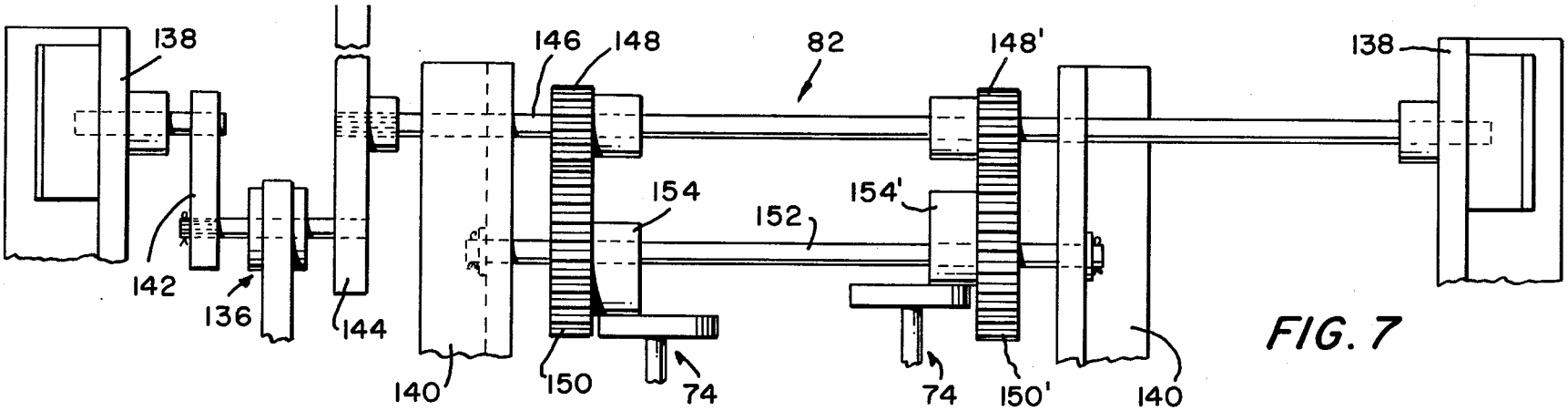

FIG. 8 illustrates a portion of the carrier element 110 and, as can be seen, a first side weldment 114 thereof mounts an actuator 132. This is a structually accurate depiction of the actuator 132 shown only diagramically in FIG. 6 (for clarity). With each translation of the pistons 98, then, rod 128 is reciprocated accordingly — for half the distance. At opposite ends thereof, rod 128 has pivot couplings 134 which, in turn, are coupled to crank units 136. Now, with reference to FIG. 7, it will be seen that crank units 136 are rotatably engaged with sub-assembly 82. Housing angle-weldments 138 and 140 (shown in both FIGS. 2 and 7) support sub-assembly 82 in optimum positioning for operating the valves 74 (and 74' and 76). Each crank unit 136 turns an eccentric 142 and a circular disk 144. The latter, through a shaft 146, rotates a drive gear 148 which meshes with a driven gear 150. Fixed to gear 150, and rotated in common therewith, on a shaft 152, is a valve-operating eccentric 154. Complementary gears 148' and 150' rotate in common with gears 148 and 150, and so also does a complementary valve-operating eccentric 154' where, however, the latter is some 90° of arc out-of-phase with eccentric 154. As shown, eccentric 154 is holding a valve 74 in an open position, whereas eccentric 154' has released a valve 74 to allow the same to be closed.

Valve structure is shown in FIG. 11, in cooperation with a fragment of a sub-assembly; of the latter, only a portion of a driven gear 150, and a portion of a coacting eccentric 154 is shown. The structure comprises a valve body 156 which is threadedly fixed in an aperture 158 provided therefor in the closure head of the housing 12. The housing closure head can be attached by bolts, threads, etc. A valving plunger 160 carries a port closure element 162 at one end thereof for closure and broaching of a housing fuel (or exhaust) port 164. The other end of the plunger has an actuating cap 166. The same end encloses a disc seal 168 which seals the valve. A spring stopper 168' carried on this end of the plunger 160 receives one end of a compression spring. Spring 170 is freely enclosed in an enlarged chamber 172 formed in the body 156, and reacts from a termination of the chamber 172. A second, spaced-apart enlarged chamber 174 formed in the body 156 opens at one end on port 164 and at the other end thereof onto a radial port 176 formed through a wall of the body 156. A hollow pipe 178, threaded at both ends thereof, is threadedly fastened in port 176, and the extending threaded end thereof is threadedly coupled with manifold 18 (or 20).

As described earlier, weldments 114 carry actuators 132 for impingement with sleeves 130 in order to translate rods 128 of valve-operating sub-assemblies 124. Thus, with delayed, half-travel motion of rods 128, valve-operating sub-assemblies 82 effect optimum opening and closure of the valves 74, 74' and 76 to admit and exhaust fluid from cylinders 70, 70' and 72. Actuators 132 comprise upstanding walls for supporting and orienting the rods 128 for relative slidable movement thereof. They have rectangular recesses 182, 182' and 182'' formed therein to receive the rods 128; recess 182 receives the rod 128 which is operative of sub-assembly 82 for controlling valves 76 (of cylinder 72), recess 182' receives the rod 128 which is operative of sub-assembly 82 for controlling valves 74' (of cylinder 70'), and recess 182" receives the rod 128 which is operative of sub-assembly 82 for controlling valves 74 (of cylinder 70).

Cylinder 72 is above and mid-positioned between cylinders 70 and 70', and houses a piston 98' having fluid-impingement surfaces which are twice the area of the same surfaces of either of the pistons 98 in cylinders 70 or 70'. Thus, the novel system is balanced. FIG. 5 has Roman numerals I through VI in association with each of the cylinders 70, 70' and 72. With reference to the following tabulation, the simultaneous operations taking place in the so-numbered cylinder(s) can be understood. Of course, these cylinder operations are repetitive, cyclically.

| Stroke sequence | Travel, per FIG. 5 | CYLINDER I&V | II | III | IV&VI |
|---|---|---|---|---|---|
| 1. | right | power | exhaust | intake | compress. |
| 2. | left | exhaust | intake | compress. | power |
| 3. | right | intake | compress. | power | exhaust |
| 4. | left | compress. | power | exhaust | intake |

FIG. 12 depicts a first alternative embodiment of the novel system, the same comprising a system 10*a* which is, substantially, a half of the priorly described system 10. System 10*a* employs engine sub-assemblies at only one axial end of the system to pressure fluid at the opposite axial end thereof. Thus, as shown in FIG. 12, such opposite axial end has a pair of closure heads 84 for the admittance and discharge of fluid, for pressuring thereof by piston 98, in response to power strokes of a piston (not shown) in cylinder 70. Following a power stroke of the engine sub-assembly piston, in cylinder 70, the fluid pressuring piston 98 is returned — to the left, as viewed in FIG. 12 — by means of shaft return springs 200. Springs 200 are secured, by means of hardware 202, to a cross-piece 204. Cross-piece 204 is fixed to piston rod 92 by means of a setscrew 206. Springs 200 are also secured, by means of hardware 208, to a wall of housing 12. Springs 200 are expansion springs; thus, following the movement of the piston in cylinder 70 to the right, springs 200 react from housing 12 and cause the return of the piston in cylinder 70, and fluid-pressuring piston 98, to return to the left. With each axial movement of piston 98, then, fluid admitted via closure heads 84 is pressured.

A second alternative version or embodiment of the invention is shown in FIG. 13 where a system 10*b* employs a compression spring 200' to cause a "return" of the piston rod 92 and the axially-opposed pistons. In this embodiment, a cylindrical element 210 is carried by the piston rod 92, the element 210 having a circular recess 212 formed therein to nest therein one end of the shaft/-piston return spring 200'. The opposite end of the spring 200' bears against a slide bearing 214 fixed in the wall of engine housing 12'. Slide bearing 214, and its complement 214' at the other axial end, slidably and frictionlessly accommodate for the axial translation of rod 92. While neither of the pistons — the engine sub-assembly piston nor the fluid-pressuring piston — are shown, it is to be understood that the engine sub-assembly is to the left, in FIG. 13, and the fluid-pressuring sub-assembly is to the right. Thus, as the engine sub-assembly piston completes a power stroke, causing the cylindrical element 210 to move to the right, the return spring 200' will return the shaft or rod 92 to the left.

Yet a further alternative embodiment of the invention is depicted in FIG. 14 where a two-stroke cycle engine sub-assembly is shown in a system 10*c* employing the return spring 200 of FIG. 12. In this embodiment of the invention, the ignition device 78 is fixed in the outer most wall of the housing 12, and a fuel and oxidant inlet valve port 216 is formed in the innermost wall thereof, in a cylinder head 80'. A modified piston 98' is used in this embodiment; the piston 98' has an angled face 218 to direct by-passed fuel and oxidant towards the device 78. In this connection, cylinder 70' has a by-pass line 220 opening onto it and an exhaust port 222 on the opposite side of the cylinder 70'. In operation, the fuel and oxidant is ignited by the device 78, and the piston 98' moves to the right. At this time, the discharge port 222 is uncovered, and the cylinder 70' discharges the spent gases. Simultaneously, fuel and oxidant enters again via port 216 and is by-passed to the face 218 of the piston; it is the piston displacement which causes the fuel and oxidant to pass through line 220. During by-passing, of course, the inlet and exhaust ports are closed (by means not shown). Of course, it is already known in the prior art to define 2-stroke engines with such fuel and exhaust handling.

The uses to which the systems 10, 10*a* - 10*c,* can be put, and modifications thereof which are possible, are probably evident. However, it may be advisable to discuss some of these aspects here. Broadly, the system embodiments are disclosed as means for converting stored energy in fuels, chemicals, etc. into useful mechanical energy. The invention lends itself readily to the use of different fuels (combustibles) and oxidants (air, for example). It can be used to simulate a diesel cycle — with or without a sparking or ignition device. All that is necessary is to replace the fuel inlets with air inlets. Then, with the air being compressed in the power-stroke phases of operation, a suitable fuel of some type can be injected into the compressed air, and ignition will follow. In lieu of air, decomposed hydrogen peroxide can be used as well. Too, as is conventional in the field, start-up of such a diesel cycle can be initiated by an ancillary gasoline engine — or by using gasoline and air vapor in the systems, and then switching over to diesel-type fuels and oxidants. Thus, the systems disclosed herein are not limited to any particular fuel or fuel.

As disclosed and described herein, system 10 comprises a triangulated arrangement with cylinders "I,IV,V, and VI" being balanced by the larger, surmounting cylinders "III and II". It will be evident to those skilled in this art, taking teaching from my disclosure, that a differently and more-directly balanced system could be arranged, wherein four piston shafts 92 were commonly connected, in parallel, to cycle eight pistons 98 of common cross-sectional dimensions.

Different reactant liquid fuels and oxidants, as noted, can be reacted sequentially in the cylinders in conformity with an established process of cycling, and the exhaust gases can be used to drive rotary or reciprocating devices. Thus, while one engine sub-assembly is igniting fuel and deriving a power stroke therefrom, a complementary engine sub-assembly which is then exhausting gases can direct the exhaust product to useful work. Such exhaust gases can be compressed and then discharged to a pressure tank — a pressure surge tank similar to chamber 34 (FIG. 1). Provision would be made, however, to separate out an entrapped liquid or water from the gases (by means of a trap). Dry gas, then, from the pressure surge tank would be put to work operating rotary or reciprocating machines. In such applications, then, the fluid-pressuring sub-assemblies of the systems would be used for piston lubrication and cooling only. After the gases have been expended in the rotary or reciprocating devices, they can be vented to the atmosphere and, prior to admitting the gases to the rotary or reciprocating devices or machines, they can be passed into exchange with a catalytic converter to purge therefrom any deleterious constituents — if such will be injurious to the machines or humans; otherwise, it will be sufficient to arrange the converter at the inlet of the surge tank.

In my U.S. Pat. No. 3,791,142, issued 12 Feb. 1974, I teach a novel "Fluid Powered Engine" in which energized fluid, such as gas, drives a turbine and exhausts the same through nozzles to the atmosphere. In that said patented Engine requires pressured or otherwise energized fluid, the instant invention would have especial utility in such an Engine.

The systems depicted herein present structures which are of one-piece fabrication (for example, FIG. 10), but of course, such structures can equally well be built-up from separate components. Too, related and cooperating parts are shown as threaded or bolted together, where — in most cases — they could just as well be vice versa. It is to be understood that, while I have described my invention in connection with specific embodiments thereof, this is done only by way of example and not as a limitation to the scope of my invention as set forth in the objects thereof and in the appended claims.

I claim:

1. A fluid energy system, comprising:

means defining an internal combustion engine;

said engine-defining means comprising means for generating pressured working fluid;

means for storing pressured working fluid;

means for conducting pressured working fluid from said engine-defining means to said storage means for storage; and means for discharging stored, pressured working fluid from said storing means for use in powering ancillary fluid-powered machines; wherein said engine-defining means define at least one reciprocating, internal combustion engine;

said at least one engine having at least a first pair of cylinders disposed in juxtaposition, and a second pair of cylinders, also disposed in juxtaposition, and double-acting pistons, each of said cylinders having one of said pistons reciprocatable therewithin;

a first of said pistons, which is reciprocatable in one cylinder of said first pair of cylinders, is rigidly fixed to one end of a first, piston rod;

a second of said pistons, which is reciprocatable in one cylinder of said second pair of cylinders, is rigidly fixed to the other end of said first piston rod;

a third of said pistons, which is recprocatable in the other cylinder of said first pair of cylinders, is rigidly fixed to one end of a second, piston rod;

a fourth of said pistons, which is reciprocatable in the other cylinder of said second pair of cylinders, is rigidly fixed to the other end of said second piston rod; and said first and second piston rods are commonly coupled to a single, rigid carrier for coincident reciprocation together;

said system further including means for addressing working fluid to one of two opposite ends of each of said pistons, to cause said working fluid to be pressured by said pistons during power strokes of said pistons;

said pistons have means for communicating a quantity of working fluid addressed to said one ends thereof with slidably interfacing walls of said pistons and their associated cylinders for lubricating said walls, and means prohibiting a communication of said quantity of fluid with the other of said opposite ends of said pistons;

means coupled to said cylinders operative for admitting fuel thereinto for ignition to operate on said opposite ends of said pistons, to drive said pistons in power strokes;

means coupled to said rigid carrier for operating said fuel admitting means coincident with reciprocation of said carrier and said piston rods; wherein said fuel admitting means comprises intake and exhaust valving;

said operating means comprises means actuable for operating said valving, and means borne by said carrier for actuating said valving-operating means;

said valving-operating means and said actuating means are co-operative to effect a lost motion, between said valving-operating means and said actuating means, to cause said valving-operating means to manifest a delayed response to motion induced in said carrier;

said carrier has recesses formed therein;

said actuating means comprises a pair of parallel, reciprocatable rods;

said latter rods are slidably disposed in said recesses, and each of said latter rods has a pair of spaced-apart prominences thereon; and said carrier has a limb projecting therefrom, intermediate said prominences, for alternating and delayed contacting engagement directly with said spaced-apart prominences to cause reciprocation of said pair of parallel, reciprocatable rods; and said reciprocatable rods are coupled to crank units which rotate valve-operating eccentrics.

2. A system, according to claim 1, further including:

means for causing said at least one pistons to effect a return stroke following power strokes thereof.

3. A system, according to claim 1, wherein:

said carrier has a first electro-magnetic component fixed thereto; and further including a second electro-magnetic component disposed for close-coupled engagement with said first component;

said first and second components comprising means cooperative for causing said carrier and said pistons to effect an axial stroke.

4. A system, according to claim 1, further including:

ancillary fluid-powered machines; wherein said fluid discharging means comprises means for conducting pressured working fluid from said storing means to said machines, for powering of said machines, and said addressing means comprises means for returning working fluid to an end of said at least one piston; and said returning means includes means defining a fluid reservoir;

said reservoir being interpositioned between said machines and said at least one engine.

* * * * *